US005199197A

United States Patent [19]

Thuerman

[11] Patent Number: 5,199,197

[45] **Date of Patent: * Apr. 6, 1993**

[54] WEAR RESISTANT OFFSET SIDEBAR CHAIN

[75] Inventor: John H. Thuerman, Waukesha, Wis.

[73] Assignee: Rexnord Corporation, Milwaukee, Wis.

[ * ] Notice: The portion of the term of this patent subsequent to Jul. 17, 2007 has been disclaimed.

[21] Appl. No.: 535,846

[22] Filed: Jun. 11, 1990

Related U.S. Application Data

[63] Continuation-in-part of Ser. No. 310,240, Feb. 13, 1989, Pat. No. 4,941,315.

[51] Int. Cl.[5] ..... E02F 5/06; F16G 13/06

[52] U.S. Cl. ..... 37/465; 37/355; 37/452; 59/5; 59/8; 59/84

[58] Field of Search ..... 59/5, 6, 7, 8, 78, 84; 37/141 R, 142 R, 141 T, 83, 86, 191 A, 192 R, 192 A

[56] References Cited

U.S. PATENT DOCUMENTS

| | | | |
|---|---|---|---|
| 1,281,934 | 10/1918 | Fraser | 198/851 |
| 1,953,388 | 4/1934 | Bettin | 198/851 |
| 3,153,867 | 10/1964 | Golden | 37/191 A |
| 3,595,011 | 7/1971 | Nicholson | 59/8 |
| 3,754,341 | 8/1973 | Caldwell et al. | 37/191 A |
| 3,830,054 | 8/1974 | Tamamura et al. | 59/84 |
| 3,854,363 | 12/1974 | Merkell et al. | 83/830 |
| 3,913,979 | 10/1975 | Strauss et al. | 37/191 A |
| 3,932,951 | 1/1976 | Scott et al. | 37/86 |
| 4,363,178 | 12/1982 | Erickson | 83/831 |
| 4,404,761 | 9/1983 | Paulin et al. | 37/191 A |
| 4,464,151 | 8/1984 | Kahl | 474/231 |
| 4,509,323 | 4/1985 | Ledvina | 59/8 |
| 4,562,761 | 1/1986 | Alexander | 83/830 |
| 4,571,859 | 2/1986 | Leischer | 37/191 A |
| 4,660,611 | 4/1987 | Gockley et al. | 59/84 |
| 4,833,797 | 5/1989 | Slunecka et al. | 37/86 |
| 4,893,464 | 1/1990 | Thuerman | 59/78 |
| 4,941,315 | 7/1990 | Thuerman | 59/5 X |

FOREIGN PATENT DOCUMENTS

| | | | |
|---|---|---|---|
| 213746 | 6/1968 | U.S.S.R. | 299/82 |

OTHER PUBLICATIONS

Chain Belt Company, Catalog No. 520, Jan. 1950.
Chain Belt Company, Bulletin No. 54–54, 1955.
American Chain Association, Design and Applications Handbook 1982.
Caterpillar Industrial Products, Inc., Track Chain Literature 1983.
Trencher Jetco, Models 830L and 1400L Chain Trenchers Sep. 1985.
Illustration of a trenching machine and a conventional straight sidebar type of chain.
"Metals Handbook" American Society for Metals, vol. 2, pp. 167, 168, 1964.

*Primary Examiner*—Randolph A. Reese
*Assistant Examiner*—Arlen L. Olsen
*Attorney, Agent, or Firm*—Michael, Best & Friedrich

[57] ABSTRACT

A sidebar is provided for an offset sidebar trenching chain. The sidebar has an inner edge which slides along a boom of a trenching machine, when the trenching chain is in use. The sidebar is induction hardened through a portion thereof extending from the inner edge, for increased resistance to wear due to friction.

36 Claims, 3 Drawing Sheets

WEAR RESISTANT OFFSET SIDEBAR CHAIN

CROSS REFERENCE TO RELATED APPLICATION

This application is a continuation-in-part of U.S. Patent Application Serial No. 07/310,240, filed Feb. 13, 1989, now U.S. Pat. No. 4,941,315, entitled "Wear Resistant Chain for Trenchers."

FIELD OF THE INVENTION

The invention relates to chains, and more particularly to chains for trenching machines and other similar applications.

BACKGROUND OF THE INVENTION

Trenching machines commonly include a digging chain supported on a boom. In use, the boom extends from the machine and downwardly, and the digging chain is fastened to and around the boom. The digging chain supports a plurality of spaced apart digging or cutting teeth which contact the ground to be trenched.

During operation of the trencher, as the chain moves continuously along the edge of the boom, the frictional contact between the chain and surfaces of the boom causes wear of the chain links, and this wear is aggravated as dirt and grit comes between the chain and the boom during trenching.

Additionally, during operation of the trencher, if the cutters encounter obstructions or hard material, backflexing of the chain links tends to occur as cutters supported by the links contact the surface being trenched. This backflexing of the chain links and cutters tends to reduce the effectiveness of the cutters and may also cause increased friction between certain surfaces of the chain and the boom of the trencher and uneven chain link wear.

While in some chain link sidebars a central portion of the edge that slidingly contacts a supporting surface has been induction hardened in an effort to reduce chain wear, the prior art does not provide a sidebar with effective means to reduce chain wear at the forward and rearward ends of the edge of the chain link where frictional wear is greatest.

SUMMARY OF THE INVENTION

A chain is provided having a plurality of chain links joined together by chain pins. At least one of the chain links includes a sidebar which has a first edge adapted to be supported in sliding contact with a supporting surface. The first edge is generally linear and extends in the direction of movement of the chain with respect to the support surface. The sidebar includes an opposite edge spaced from and generally parallel to the first edge, a trailing end having a first pitch hole passing through it, and a leading end having a second pitch hole passing through it. At least one of the leading end and the trailing end of the sidebar include an induction hardened portion adjacent the first edge.

In one aspect of the invention the induction hardened portion of the sidebar further extends between the first edge and a line extending generally parallel to the first edge. The line is spaced between the pitch holes and the first edge.

In one aspect of the invention, the chain sidebars also have a configuration which provides reduced backflexing of chain links when a load is applied to the cutters supported by the chain.

In one aspect of the invention, the chain is used in conjunction with a trenching or conveying machine.

In another aspect of the invention, the chain is an offset sidebar chain, and each sidebar that includes an induction hardened portion also includes an offset bend defined by two continuous bend lines extending in the direction normal to the surface against which the sidebar is adapted to sliding contact and extending through the full height of the sidebar.

These and other features and advantages of the invention will become apparent to those skilled in the art upon review of the following detailed description of the preferred embodiment of the invention, which is given by way of example only, reference being made to the appended drawings.

DETAILED DESCRIPTION OF THE PREFERRED EMBODIMENTS OF THE INVENTION

Figure 1:
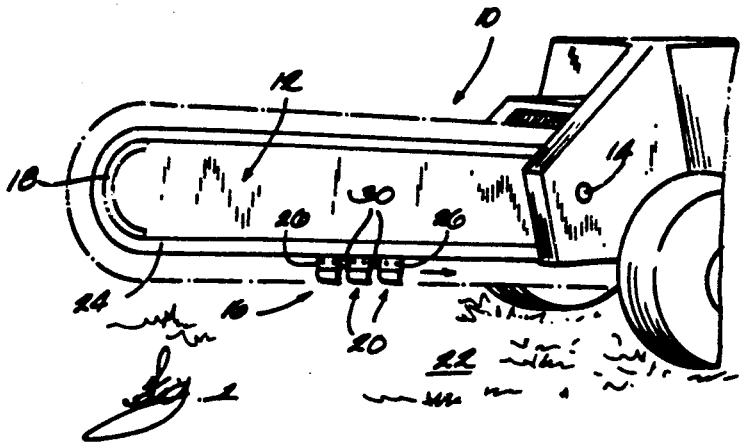
FIG. 1 is a perspective view of a trenching machine embodying the invention.

Referring to FIG. 1, a trenching machine 10 can be seen having a digging boom 12 which is adapted to pivot about an axis 14 during a trenching operation.

A digging chain 16 is mounted on the digging boom 12, and is supported by guide means at one end of the chain loop, and is drivingly engaged by a sprocket at the other end of the chain loop. In the illustrated embodiment, the guide means is a sprocket or guide wheel 18. The chain 16 supports a plurality of cutter tools 20, which act on a surface 22 to be trenched when the boom 12 is lowered and the chain 16 is driven, during a trenching operation.

During trenching, friction is developed between the chain 16 and the lower portion 24 of the digging boom 12, where the chain 16 slidingly contacts the digging boom 12, while pressure is exerted from the chain 16 on the lower portion 24 of the digging boom.

Figure 2:
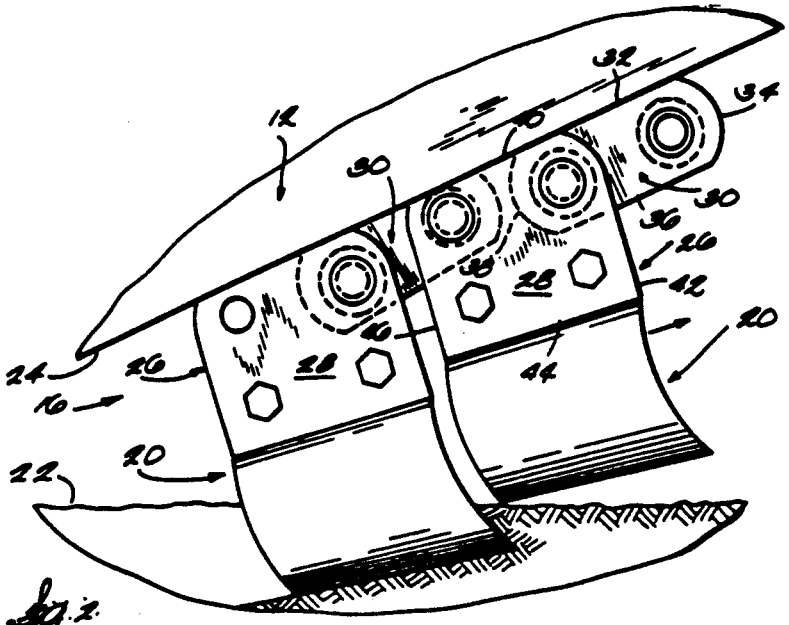
FIG. 2 is a side view of a broken away section of the chain used in the trenching machine shown in FIG. 1 and which shows chain wear patterns that result over time due to forces encountered by cutters supported by the chain as they contact the surface to be trenched.

As the cutter tools 20 contact the surface 22 being trenched, the cutter tools tend to cause backflex of the chain links supporting the cutter tools. Referring now to FIG. 2, it can be seen how the chain links tend to wear over time due to backflex that occurs as the cutter tools 20 contact the surface 22.

The chain 16 of the preferred embodiment of the invention is comprised of sidebars 26 that include a portion 28, to which the cutter tool 20 is attached, as well as connecting sidebars 30.

Each connecting sidebar 30 has a first edge 32, which slidingly contacts the boom 12, a leading periphery 34, an opposite edge 36, and a trailing periphery 38. As can be seen, the first edge 32 is subject to frictional forces at a portion thereof proximate to the leading periphery 34 of the connecting sidebar 30. Similarly, each sidebar 26, having a portion 28 for supporting a cutter tool 20, has a basis portion 29, a first edge 40, a leading periphery 42, an opposite edge 44, and a trailing periphery 46. In the drawings, the portion 28 of the sidebar 26 extends from, and is coplanar with the portion 29; however, it is envisioned that in other embodiments the portion 28 of the sidebar 26 could be bent at 90° relative to the basis portion 29, or could be welded to the portion 29. As can be seen, the first edge 40 is subject to frictional forces at a portion thereof proximate to the trailing periphery 46 of each sidebar 26 having a portion for supporting a cutter tool. Further, the leading periphery 34 of each connecting sidebar 30 and the trailing periphery 46 of each sidebar 26 having a portion for supporting a cutter tool are subject to frictional forces proximate to the first edges 32 and 40 of the sidebars.

Figure 3:
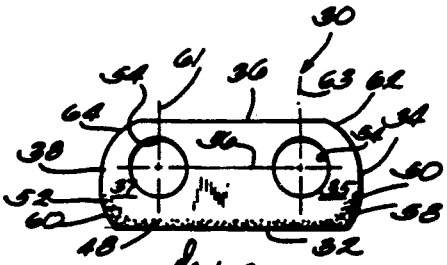
FIG. 3 shows in detail a side view of one of the connector sidebars of the chain shown in FIG. 2, without wear.

Referring now to FIG. 3, one of the connecting sidebars 30 shown in FIG. 2 can be seen in more detail. The sidebar 30 is induction hardened, in the preferred embodiment, along a portion 48 thereof extending from its first edge 32, for increased resistance to wear due to friction. Extending from the leading periphery 34 and trailing periphery 38 of the sidebar 30 are portions 50 and 52, respectively, which are induction hardened for increased resistance to wear, and which abut the portion 48 extending from the first edge 32 of the connecting sidebar 30. It is envisioned that portion 48 might not be induction hardened in some applications.

Pitch holes 54 are provided in the leading end 34 and trailing end 38, respectively, of sidebar 30 to allow the sidebar to be attached to the other sidebar of the pair of sidebars that form a link, as well as to a sidebar of another link in the chain 16. These pitch holes have centers on an axis 56 which is parallel to the first edge 32. The pitch holes are spaced from the first edge 32 by a distance greater than the distance between the pitch holes and the opposite edge 36. This provides an increased material thickness and permits increased chain wear before chain failure becomes likely.

As can be seen, the total portion of the sidebar 30 that is induction hardened is spaced from the pitch holes 54.

The sides 34 and 38 of the sidebar 30 include arcuate portions 58 and 60 intersecting the first edge 32, as well as arcuate portions 62 and 64, intersecting the opposite edge 36. While the arcuate portions 62 and 64 each have a center of curvature which is generally halfway between the first edge 32 and the opposite edge 36, the arcuate portions 58 and 60 each have a center of curvature which is below the axis 56. In FIG. 3, the arcuate portions 58 and 60 each have a center of curvature which is closer to the first edge 32 than to the opposite edge 36. This results in first edge 32 being longer than opposite edge 36. The pitch hole 54 through the trailing end 38 has a center that falls on a first transverse axis 61. The pitch hole 54 through the leading end 34 has a center that falls on a second transverse axis 63. The transverse axes 61 and 63 are perpendicular to the axis 56. The distance along the first edge 32 between the first transverse axis 61 and the trailing periphery 38 exceeds one half, and more particularly exceeds three quarters of the perpendicular distance between the axis 56 and the first edge 32. It has been found that this configuration results in reduced chain backflex, and therefore reduced chain wear.

Figure 4:
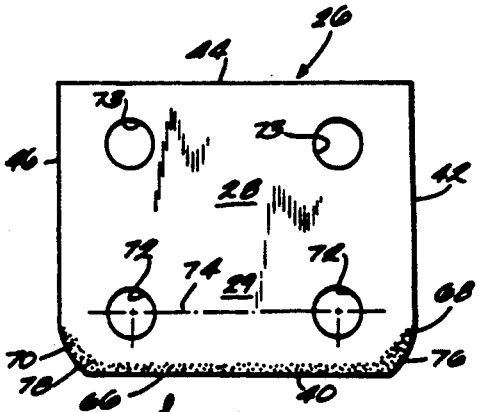
FIG. 4 shows in detail a side view of one of the tool supporting sidebars of the chain shown in FIG. 2, without wear.

Referring now to FIG. 4, one of the sidebars 26 shown in FIG. 2 and having a portion 28 for supporting a tool, is shown in detail. The sidebar 26 is induction hardened, along a portion 66 thereof extending from its first edge 40, for increased resistance to wear due to friction. Extending from the leading periphery 42 and the trailing periphery 46 of the sidebar 26 are portions 68 and 70, respectively, which are induction hardened for increased resistance to wear, and which abut the portion 66 extending from the first edge 40 of the sidebar 26.

Pitch holes 72 are provided in the basis portion 29 of the sidebar 26, which holes have centers along an axis 74 which is spaced apart from the first edge 40 by a distance which equals the distance that the axis 56 is separated from the first edge 32 of the connecting sidebar 30 shown in FIG. 3. Further, bolt holes 73 are provided in the portion 28 of the sidebar 26 to allow bolting of each cutter tool 20 to each sidebar 26. Alternatively, cutter tools 20 could be welded to sidebars 26.

The sides 42 and 46 of the sidebar 26 include arcuate portions 76 and 78, respectively, ending at the first edge 40. The arcuate portions 76 and 78 each have a center of curvature which is spaced apart from the first edge 40 by a distance which equals the distance that the center of curvature of each of the arcuate portions 58 and 60 is separated from the first edge 32 of the connecting sidebar 30 shown in FIG. 3.

Figure 5:
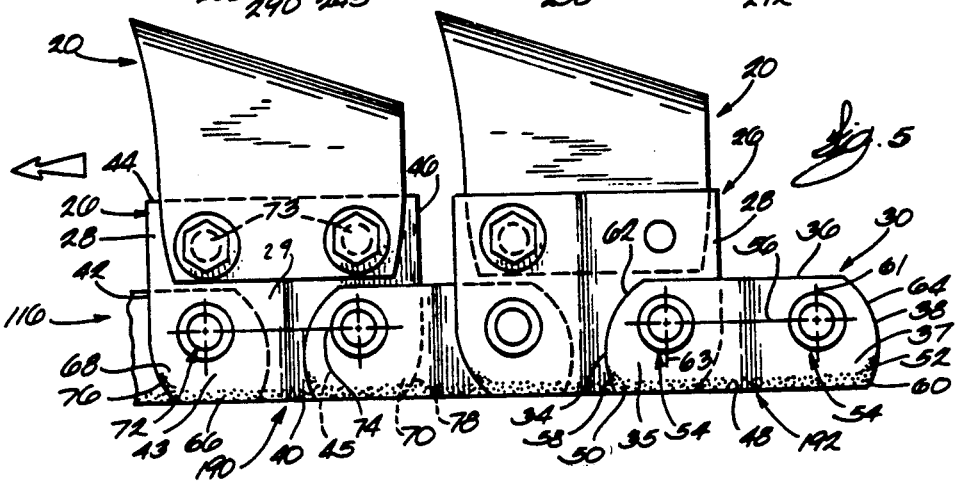
FIG. 5 is a side view of a broken away section of an alternative chain that can be used in the trenching machine shown in FIG. 1.

Shown in FIG. 5 is a section of a chain 116 that is similar to the chain 16 shown and described in conjunction with FIGS. 2-4, like reference numerals indicating like components that will not be described again in detail. The chain 116 is different from the chain 16 in that it is an offset sidebar chain. The configurations of the sidebars 26 and 30 of the chain 116 are substantially identical to the sidebars 26 and 30 of the chain 16, except that the sidebars 26 and 30 include offset bends 190 and 192, respectively.

Figure 7:
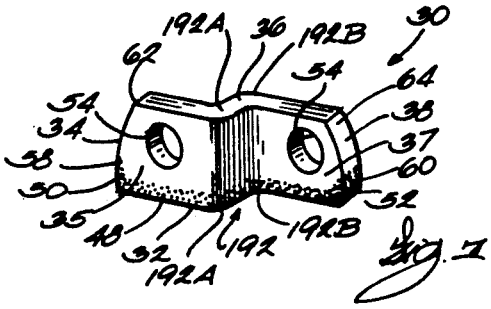
FIG. 7 is a perspective view of a connector sidebar from the section of chain shown in FIG. 5.

More particularly, the offset bend 190 is defined by two continuous bend lines 190A and 190B extending in the direction normal to the surface against which the sidebar 26 is adapted to slidingly contact, such as the surface 24 when the sidebar 26 is in contact therewith. Similarly, the offset bend 192 is defined by two continuous bend lines 192A and 192B extending in the direction normal to the surface against which the sidebar 30 is adapted to slidingly contact, such as the surface 24 when the sidebar 30 is in contact therewith (see also FIG. 7). Thus, the sidebar 26 has a leading end 43 that is parallel to and offset from a trailing end 45. The bend lines 190A and 190B, and 192A and 192B, are relatively sharp bends. The sidebars 26 including the bend lines 190A and 190B, and the sidebars 30 including the bend lines 192A and 192B are preferably formed by cold stamping steel plates, as opposed to by hot forging, for reduced cost of production.

Figure 9:
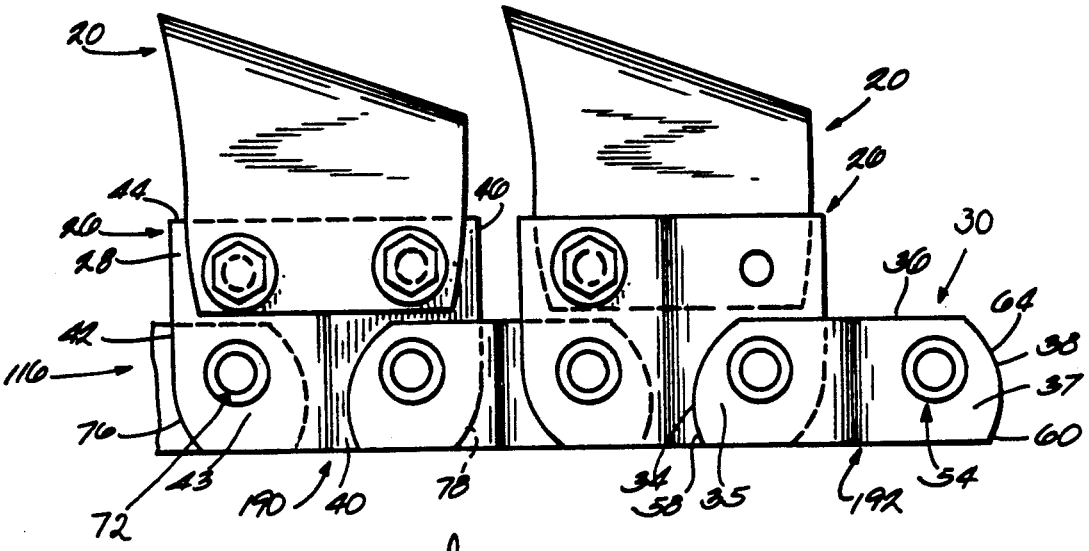
FIG. 9 is a side view of a broken away section of a third alternative chain that can be used on the trenching machine shown in FIG. 1.

FIG. 9 show one embodiment of the invention that is similar to the embodiment shown in FIG. 5, but wherein the offset sidebar chain 116 is not induction hardened at all. The pitch holes 54 and 72 of the sidebars 30 and 26 of the chain 116 shown in FIGS. 5 and 9 are placed for increased material thickness between the pitch holes and the edges 32 and 40, respectively, and the arcuate portions 58, 60, 76, and 78 of the sidebars 30 and 26 of the alternative chain do provide for reduced chain backflex (in the manner described above in conjunction with the chain 16).

Figure 8:
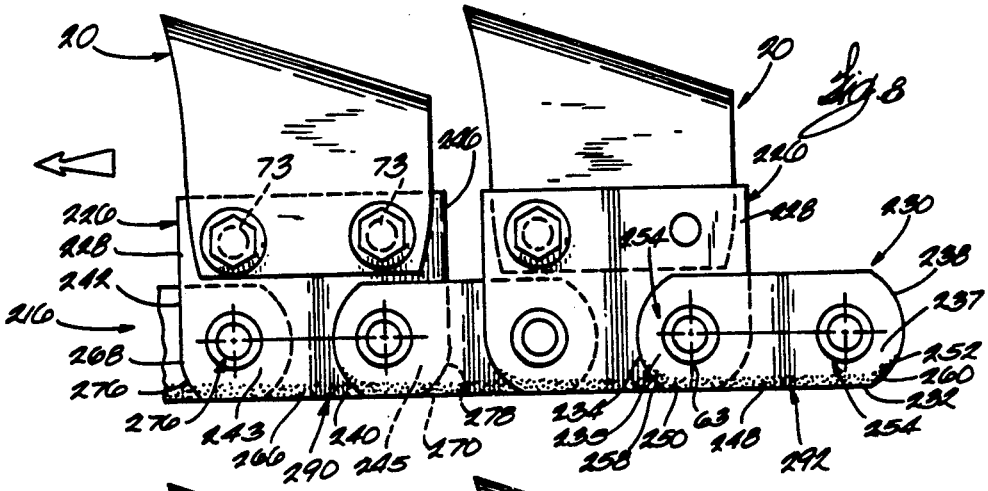
FIG. 8 is a side view of a broken away section of a second alternative chain that can be used in the trenching machine shown in FIG. 1.

Shown in FIG. 8 is a section of a chain 216 that is substantially identical to the chain shown and described in U.S. Pat. No. 4,893,464, issued on Jan. 16, 1990 to the assignee of the invention disclosed herein, the specification of which is incorporated herein by reference. The chain 216 is different from the chain shown and described in U.S. Pat. No. 4,893,464 in that at least one connecting sidebar 230 of the chain 216 is induction hardened along a portion 248, extending from a first edge 232 of the connecting sidebar 230. Further, at least one sidebar 226 having a portion 228 for supporting a tool is induction hardened along a portion 266 extending from a first edge 240 of the sidebar 226 Extending from a leading periphery 234 and a trailing periphery 238 of a leading end 235 and a trailing end 237, respectively, of the sidebar 230 are portions 250 and 252, respectively, that are induction hardened and that abut the portion 248 extending from the first edge 232 of the connecting sidebar 230. Extending from a leading periphery 242 and a trailing periphery 246 of a leading end 243 and a trailing end 245, respectively, of the sidebar 226, are portions 268 and 270, respectively, that are induction hardened and that abut the portion 266 extending from the first edge 240 of the sidebar 226. The induction hardening of the sidebars 230 and 226 provides for increased resistance to wear. It is envisioned that the portion 248 might not be induction hardened in some applications so that only at least one of the leading end 235 and the trailing end 237 of the sidebar 230 will include an induction hardened portion, 250 or 252, adjacent the first edge 232. Similarly, the portion 266 might not be induction hardened in some applications so that only at least one of the leading end 243 and the trailing end 245 of the sidebar 226 will include an induction hardened portion 268 or 270 adjacent the first edge 240.

Thus, the chain 216 is also substantially identical to the chain 116, in that the sidebars 226 and 230 include continuous offset bends 290 and 292 that are formed and that are defined in the same fashion as the offset bends 190 and 192. The chain 216 is different from the chain 116 because the pitch holes 254 and 272 in the sidebars 230 and 226, respectively, are not necessarily placed for increased material thickness between the pitch holes and the edges 232 and 240 (the pitch holes 254 and 272 of the sidebars 230 and 226 of the chain 116 are placed for increased material thickness between the pitch holes and the edges 32 and 40, respectively), and because arcuate portions 258 and 260, and 276 and 278 of the sidebars 230 and 226, respectively, do not necessarily provide for reduced chain backflex (the arcuate portions 58, 60, 76, and 78 of the sidebars 230 and 226 of the chain 116 provide for reduced chain backflex).

It is envisioned that the chain 16 could be used in conjunction with a conveying, or asphalt scraping machine, instead of with a trencher, and conveying or scraping tools can be attached to the tool supporting portions 28 of the sidebars. Instead of by means of bolts through bolt holes 73, tools can be attached in other ways, such as by welding the tools to the tool supporting portions 28 of the sidebars 26.

Figure 6:
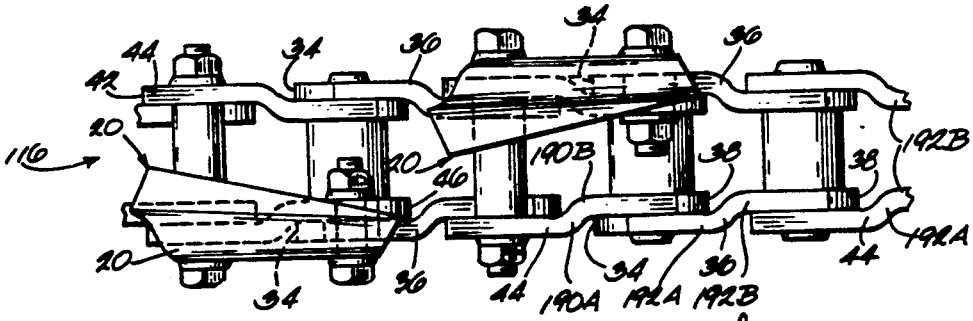
FIG. 6 is a top view of the section of chain shown in FIG. 5.

In the chains 16, 116 and 216 of the illustrated embodiments, alternative pairs of offset sidebars of the chain are extended height sidebars each having a portion 28 or 228 for supporting a tool. While other configurations are possible, FIG. 6 shows a cutter 20 fastened to alternate sides of the chain at each alternate pair of extended height sidebars of the chain. It is envisioned that extended height sidebars could be provided on every second, third, or fourth link of the chain, for example, or that other spacing arrangements could be used. Similarly, attachments or tools, such as cutters 20, could be provided on every second, third, or fourth pair of extended height sidebars for example, or other spacing arrangements could be used - in other words, not every pair of extended height sidebars need support a tool.

As most clearly shown in FIG. 6, when the tool to be attached to the extended height sidebars 26 or 226 is a cutter 20, it is fastened by fastening means such as bolts to both sidebars of each pair of extended height sidebars 26 or 226 at the forward (open) end of the pair with a bushing or spacer surrounding the bolt to maintain a proper distance between the sidebars. The cutter 20 is fastened to only one sidebar of the pair of extended height sidebars 26 or 226 at the rearward (closed) end of the pair of extended height sidebars 26 or 226 by a second fastening means, such as a second bolt, with a second spacer surrounding the second bolt and separating the cutter 20 from the one sidebar. (The second spacer is provided to compensate for the distance that the forward end is offset from the rearward end of each pair of extended height sidebars). The cutter 20 is fastened to both sidebars of each pair of extended height sidebars 26 or 226 at the forward end of the pair in order to distribute and equalize the forces transmitted from the cutter 20, when the chain is used on a trenching machine, to both sidebars of the pair of extended height sidebars 26 or 226 to which the cutter 20 is attached, while at the rearward end of the pair cost and weight is saved by fastening the cutter 20 to only one sidebar.

While a preferred embodiment of the invention has been disclosed, by way of example, various obvious modifications will become apparent to those skilled in the art. Thus, the scope of the invention should be limited only by the spirit and scope of the following claims.

I claim:

1. An offset sidebar chain comprising a plurality of chain links joined together by chain pins, at least one of the chain links including a sidebar having a first edge adapted to be supported in sliding contact with a supporting surface, said first edge being generally linear and extending in the direction of movement of the chain with respect to the support surface, and the sidebar including an opposite edge spaced from and generally parallel to said first edge, a trailing end having a first pitch hole therethrough and a leading end having a second pitch hole therethrough, the pitch holes housing said chain pins, at least one of the leading end and the trailing end of the sidebar including an induction hardened portion adjacent the first edge, each sidebar of each link that includes at least one induction hardened sidebar further including a continuous offset bend extending in the direction normal to the supporting surface.

2. An offset sidebar chain in accordance with claim 1 wherein said induction hardened portion of said sidebar further extends between said first edge and a line extending, in side view, generally parallel to the first edge, the line being spaced between the pitch holes and the first edge.

3. An offset sidebar chain in accordance with claim 1 wherein said induction hardened portion is spaced from each of the pitch holes.

4. An offset sidebar chain in accordance with claim 1 wherein said trailing end includes an induction hardened portion, adjacent said first edge.

5. An offset sidebar chain in accordance with claim 4 wherein said leading end includes an induction hardened portion adjacent said first edge.

6. An offset sidebar chain in accordance with claim 1 wherein a length dimension is defined in the direction of chain travel, and wherein said first edge has a greater length than said opposite edge.

7. An offset sidebar chain in accordance with claim 1 wherein the first pitch hole is closer to the opposite edge than to the first edge.

8. An offset sidebar chain in accordance with claim 7 wherein the first pitch hole and the second pitch hole each have centers that lie on a longitudinal axis which is parallel to the first edge.

9. An offset sidebar chain in accordance with claim 1 wherein said sidebar has a longitudinal axis which is parallel to said first edge, and wherein the pitch hole through said leading end and the pitch hole through said trailing end each have centers that lie on the longitudinal axis, the longitudinal axis being closer to said opposite edge than to said first edge, said chain further comprising links adapted to support tools, wherein said links adapted to support tools comprise sidebars having an extended height portion extending in the direction transverse to the longitudinal axis, a leading end having a pitch hole therethrough which has a center on the longitudinal axis to allow linking with other sidebars, and a trailing end having a pitch hole therethrough which has a center on the longitudinal axis.

10. An offset sidebar chain in accordance with claim 1 wherein the offset bend is defined by two continuous bend lines extending in the direction normal to the supporting surface.

11. An offset sidebar chain in accordance with claim 1 wherein said sidebar is formed by cold stamping steel plates.

12. An offset sidebar chain comprising a plurality of chain links joined together by chain pins, at least one of the chain links including a sidebar having a first edge adapted to be supported in sliding contact with a supporting surface, said first edge being generally linear and extending in the direction of movement of the chain with respect to the support surface, and the sidebar including an opposite edge spaced from and generally parallel to said first edge, a trailing end having a first pitch hole therethrough, and a leading end having a second pitch hole therethrough, the pitch holes housing said chain pins, the first pitch hole having a center that lies on a longitudinal axis which is parallel, in side view, to said first edge, said sidebar having at its trailing end a trailing periphery extending between said first edge and said opposite edge, wherein the center of the first pitch hole lies on a first transverse axis which is perpendicular to the longitudinal axis and which intersects said first edge, and the distance along said first edge between the first transverse axis and said trailing periphery exceeds approximately three quarters of the perpendicular distance between the longitudinal axis and said first edge, said sidebar including a continuous offset bend extending in the direction normal to the supporting surface.

13. An offset sidebar for a chain comprising a plurality of chain links joined together by chain pins, said sidebar having a first edge adapted to be supported in sliding contact with a supporting surface, the sidebar including an opposite edge spaced from and generally parallel to said first edge, a trailing end having a first pitch hole therethrough, and a leading end having a second pitch hole therethrough, the pitch holes being adapted to allow the sidebar to be joined to another sidebar by a chain pin, at least one of the leading end and the trailing end of the sidebar including an induction hardened portion adjacent the first edge, said sidebar including a continuous offset bend extending in the direction normal to the supporting surface.

14. An offset sidebar chain in accordance with claim 13 wherein the offset bend is defined by two continuous bend lines extending in the direction normal to the supporting surface.

15. An offset sidebar chain in accordance with claim 13 wherein said sidebar is formed by cold stamping steel plates.

16. A trenching machine comprising a digging boom, a drive sprocket at one end of the boom, guide means at the other end of the boom, and an offset sidebar chain mounted on said sprocket and said guide means, for rotation about said boom, said chain including a plurality of chain links joined together by chain pins, at least one of the chain links including a sidebar having a first edge supported for sliding contact with said boom, said first edge being generally linear and extending in the direction of movement of the chain with respect to the boom, and the sidebar including an opposite edge spaced from and generally parallel to said first edge, a trailing end having a first pitch hole therethrough and a leading end having a second pitch hole therethrough, the pitch holes housing said chain pins, at least one of said leading end and said trailing end of said sidebar including an induction hardened portion adjacent said first edge, each sidebar of each link that includes at least one induction hardened sidebar further including a continuous offset bend extending in the direction normal to the portion of the boom supporting the link as the link slidingly contacts the boom.

17. A trenching machine in accordance with claim 16 wherein said induction hardened portion of said sidebar further extends between said first edge and a line extending, in side view, generally parallel to the first edge, the line being spaced between the pitch holes and the first edge.

18. A trenching machine in accordance with claim 16 wherein said induction hardened portion is spaced from each of the pitch holes.

19. A trenching machine in accordance with claim 16 wherein said trailing end includes an induction hardened portion, adjacent said first edge.

20. A trenching machine in accordance with claim 16 wherein said leading end includes an induction hardened portion adjacent said first edge.

21. A trenching machine in accordance with claim 16 wherein a length dimension is defined in the direction of chain travel, and wherein said first edge has a greater length than said opposite edge.

22. A trenching machine in accordance with claim 16 wherein the first pitch hole is closer to the opposite edge than to the first edge.

23. A trenching machine in accordance with claim 16 wherein the first pitch hole and the second pitch hole each have centers that lie on a longitudinal axis which is parallel to the first edge.

24. A trenching machine in accordance with claim 16 wherein said sidebar has a longitudinal axis which is parallel to said first edge, and wherein the pitch hole through said leading end and the pitch hole through said trailing end each have centers that lie on the longitudinal axis, the longitudinal axis being closer to said opposite edge than to said first edge, said chain further comprising links adapted to support tools, wherein said links adapted to support tools comprise sidebars having an extended height portion extending in the direction transverse to the longitudinal axis, a leading end having a pitch hole therethrough which has a center on the longitudinal axis to allow linking with other sidebars, and a trailing end having a pitch hole therethrough which has a center on the longitudinal axis.

25. A trenching machine in accordance with claim 24 wherein the offset bend is defined by two continuous bend lines extending in the direction normal to the supporting surface.

26. A trenching machine in accordance with claim 24 wherein said sidebar is formed by cold stamping steel plates.

27. A trenching machine comprising a digging boom, a drive sprocket at one end of the boom, guide means at the other end of the boom, and a chain mounted on said sprocket and said guide means, for rotation about said boom, said chain including a plurality of chain links joined together by chain pins, at least one of the chain links including a sidebar having a first edge supported for sliding contact with said boom, said first edge being generally linear and extending in the direction of movement of the chain with respect to said boom, and the sidebar including an opposite edge spaced from and generally parallel to said first edge, a trailing end having a first pitch hole therethrough, and a leading end having a second pitch hole therethrough, the pitch holes housing said chain pins, the first pitch hole having a center that lies on a longitudinal axis which is parallel, in side view, to said first edge, said sidebar having at its trailing end a trailing periphery extending between said first edge and said opposite edge, wherein the center of the first pitch hole lies on a first transverse axis which is perpendicular to the longitudinal axis and which intersects said first edge, and the distance along said first edge between the first transverse axis and said trailing periphery exceeds approximately three quarters of the perpendicular distance between the longitudinal axis and said first edge, said sidebar including a continuous offset bend extending in the direction normal to the supporting surface.

28. A trenching machine comprising a digging boom, a drive sprocket at one end of the boom, guide means at the other end of the boom and an offset chain mounted on said sprocket and said guide means, for rotation about said boom, said chain including a plurality of chain links joined together by chain pins, at least one of the chain links including a sidebar having a first edge supported for sliding contact with said boom, said first edge being generally linear and extending in the direction of movement of the chain with respect to the boom, and the sidebar including an opposite edge spaced from and generally parallel to said first edge, a trailing end having a first pitch hole therethrough, and a leading end having a second pitch hole therethrough, the pitch holes housing said chain pins, said sidebar having at the trailing end thereof a trailing periphery extending between said first edge and said opposite edge wherein the center of the pitch hole through said trailing end of said sidebar lies on a first transverse axis which is perpendicular to the longitudinal axis and which intersects said first edge, said trailing periphery having a first arcuate portion extending from said first edge, said first arcuate portion having a center of curvature that lies on the first transverse axis and that is located between the longitudinal axis and said first edge, the distance along said first edge between the first transverse axis and said trailing periphery exceeding half of the distance between the longitudinal axis and said first edge, at least one of said leading end and said trailing end of the sidebar including an induction hardened portion adjacent said first edge, each sidebar of each link that includes at least one induction hardened sidebar further including a continuous offset bend extending in the direction normal to the portion of the boom supporting the link as the link slidingly contacts the boom.

29. A trenching machine in accordance with claim 28 wherein said induction hardened portion of said sidebar further extends between said first edge and a line extending generally parallel to said first edge, in side view, the line being spaced between the pitch holes and said first edge.

30. A trenching machine in accordance with claim 28, wherein said induction hardened portion is spaced from each of the pitch holes.

31. A trenching machine in accordance with claim 28 wherein said trailing end includes an induction hardened portion, adjacent said first edge.

32. A trenching machine in accordance with claim 28, wherein said leading end includes an induction hardened portion adjacent said first edge.

33. A trenching machine in accordance with claim 28, said sidebar having at the leading end thereof a leading periphery extending between said first edge and said opposite edge wherein the center of the pitch hole through said leading end of said sidebar lies on the longitudinal axis and lies on a second transverse axis which is spaced from and parallel to the first transverse axis, said leading periphery having a second arcuate portion extending from said first edge, said second arcuate portion having a center of curvature that lies on the second transverse axis and that is located between the longitudinal axis and the first edge.

34. A trenching machine in accordance with claim 28, wherein the centers of curvature on the first and second transverse axes are each closer to the first edge than to the opposite edge.

35. A trenching machine in accordance with claim 28 wherein the offset bend is defined by two continuous bend lines extending in the direction normal to the supporting surface.

36. A trenching machine in accordance with claim 28 wherein said sidebar is formed by cold stamping steel plates.

* * * * *